US011151931B2

(12) United States Patent
Kim et al.

(10) Patent No.: US 11,151,931 B2
(45) Date of Patent: Oct. 19, 2021

(54) SCAN DRIVER

(71) Applicant: Samsung Display Co., LTD., Yongin-si (KR)

(72) Inventors: Jong Hee Kim, Yongin-si (KR); Hyuk Kim, Yongin-si (KR); An Su Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/881,757

(22) Filed: May 22, 2020

(65) Prior Publication Data

US 2021/0074203 A1 Mar. 11, 2021

(30) Foreign Application Priority Data

Sep. 10, 2019 (KR) ..... 10-2019-0112239

(51) Int. Cl.
*G09G 3/32* (2016.01)

(52) U.S. Cl.
CPC ..... *G09G 3/32* (2013.01); *G09G 2310/0267* (2013.01)

(58) Field of Classification Search
CPC ..... G09G 3/32; G09G 2310/0267
See application file for complete search history.

(56) References Cited

U.S. PATENT DOCUMENTS 8,890,856 B2 * 11/2014 Sasaki ..... G09G 3/3614 345/208
9,336,899 B2 * 5/2016 Ochiai ..... G09G 3/3677
9,865,216 B2 1/2018 Yoon et al.
10,121,406 B2 11/2018 Jang
10,217,414 B2 2/2019 Park et al.
10,217,432 B2 2/2019 Park et al.
(Continued)

FOREIGN PATENT DOCUMENTS

KR 10-2017-0014836 2/2017
KR 10-2017-0077941 7/2017
(Continued)

OTHER PUBLICATIONS

Kyung Min Kim et al. "Bezel Free Design of Organic Light Emitting Diodes via a-InGaZnO Gate Driver Circuit Integration within Active Array" Journal of the Society for Information Display (SID), 2019.

*Primary Examiner* — Muhammad N Edun
(74) *Attorney, Agent, or Firm* — Kile Park Reed & Houtteman PLLC

(57) ABSTRACT

A scan driver includes scan stages, an n-th scan stage of the scan stages includes a first driving circuit, a second driving circuit, and an output circuit. The first driving circuit controls a voltage of a first driving node, based on an input signal and a voltage of a second driving node. The second driving circuit controls the voltage of the second driving node, based on a second clock signal and a first voltage. The output circuit outputs a first clock signal as a scan signal and a carry signal, and outputs a second voltage as the scan signal and the carry signal. The first driving circuit includes a first transistor including a gate electrode electrically connected to the second driving node, one electrode electrically connected to an input line that provides the input signal, and another electrode electrically connected to the first driving node.

20 Claims, 10 Drawing Sheets

(56) References Cited

U.S. PATENT DOCUMENTS

| | | | | |
|---|---|---|---|---|
| 2010/0090742 | A1* | 4/2010 | Zebedee | G09G 3/3674 327/296 |
| 2013/0009856 | A1* | 1/2013 | Takahashi | G11C 19/184 345/92 |
| 2017/0047030 | A1 | 2/2017 | Kim et al. | |
| 2020/0219451 | A1 | 7/2020 | Kim | |
| 2020/0243018 | A1 | 7/2020 | Kim et al. | |
| 2020/0410943 | A1 | 12/2020 | Kim | |

FOREIGN PATENT DOCUMENTS

| | | |
|---|---|---|
| KR | 10-2017-0119786 | 10/2017 |
| KR | 10-2020-0085976 | 7/2020 |
| KR | 10-2020-0094895 | 8/2020 |
| KR | 10-2021-0002282 | 1/2021 |

* cited by examiner

SCAN DRIVER

CROSS-REFERENCE TO RELATED APPLICATIONS

This application claims priority to and benefits of Korean Patent Application No. 10-2019-0112239 under 35 U.S.C. § 119, filed in the Korean Intellectual Property Office on Sep. 10, 2019, the entire contents of which are incorporated herein by reference.

BACKGROUND

1. Technical Field

The disclosure relates to a scan driver.

2. Description of the Related Art

A display device may include a data driver for supplying a data signal to data lines, a scan driver for supplying a scan signal to scan lines, and a pixel unit including pixels positioned in regions divided by the scan lines and the data lines.

Each pixel of the display device may emit light at a luminance corresponding to a data signal input through a data line. The display device may display a frame image with a combination of light emitting pixels.

Pixels may be electrically connected to each data line. Therefore, a scan driver that may provide a scan signal for selecting a pixel to which a data signal is to be supplied may be required.

To this end, the scan driver may include scan stages that may be sequentially electrically connected to each other. In order for the scan stages to operate, each of the scan stages may include oxide thin film transistors.

It is to be understood that this background of the technology section is, in part, intended to provide useful background for understanding the technology. However, this background of the technology section may also include ideas, concepts, or recognitions that were not part of what was known or appreciated by those skilled in the pertinent art prior to a corresponding effective filing date of the subject matter disclosed herein.

SUMMARY

An object of the disclosure is to provide a simpler scan stage circuit.

A scan driver according to an embodiment may include a plurality of scan stages, an n-th scan stage of the plurality of the scan stages may include a first driving circuit that controls a voltage of a first driving node based on an input signal and a voltage of a second driving node that is a scan start signal and a previous carry signal, a second driving circuit that controls the voltage of the second driving node based on a second clock signal and a first voltage, and an output circuit that outputs a first clock signal as a scan signal and a carry signal based on the voltage of the first driving node, and outputs a second voltage as the scan signal and the carry signal based on the voltage of the second driving node. The first driving circuit may include a first transistor including a gate electrode electrically connected to the second driving node, one electrode electrically connected to an input line that provides the input signal, and another electrode electrically connected to the first driving node. Here, n may be a natural number equal to or greater than one.

Each of the plurality of scan stages may be electrically connected to two clock lines among a first clock line that provides the first clock signal, a second clock line that provides the second clock signal, a third clock line that provides a third clock signal, and a fourth clock line that provides a fourth clock signal.

The first clock signal, the second clock signal, the third clock signal, and the fourth clock signal may be set at a same period, the second clock signal may be delayed by a phase difference of a ½ period from the first clock signal, the third clock signal may be delayed by a phase difference of a ¼ period from the first clock signal, and the fourth clock signal may be delayed by a phase difference of a ½ period from the third clock signal.

An m-th scan stage among the plurality of scan stages may be electrically connected to the first clock line and the second clock line, and an (m+1)-th scan stage among the plurality of scan stages may be electrically connected to the third clock line and the fourth clock line. Here, m is a natural number equal to or greater than one.

The first transistor may include a first sub transistor having a gate electrode electrically connected to the second driving node, and one electrode electrically connected to the input line, and a second sub transistor having a gate electrode electrically connected to the second driving node, one electrode electrically connected to the other electrode of the first sub transistor, and another electrode electrically connected to the first driving node.

The first driving circuit may include a second transistor having a gate electrode connected to the first driving node, one electrode connected to a first power line that provides the first voltage, and another electrode connected to the other electrode of the first sub transistor.

The input line electrically connected to the one electrode of the first transistor included in the first scan stage may be a scan start line that provides the scan start signal, and the input line electrically connected to the one electrode of the first transistor included in an r-th scan stage may be an (r−1)-th carry line that provides a carry signal output from an (r−1)-th scan stage. Here, r may be a natural number equal to or greater than two.

The scan start signal may include a first scan start signal and a second scan start signal, the input line electrically connected to the one electrode of the first transistor included in a first scan stage may be a first scan start line that provides the first scan start signal, the input line electrically connected to the one electrode of the first transistor included in a second scan stage may be a second scan start line that provides the second scan start signal, and the input line electrically connected to the one electrode of the first transistor included in an s-th scan stage may be an (s−2)-th carrier line that provides a carry signal output from an (s−2)-th scan stage. Here, s is a natural number equal to or greater than three.

The second driving circuit included in the n-th scan stage may include a third transistor having a gate electrode electrically connected to the first driving node, one electrode electrically connected to a second clock line that provides the second clock signal, and another electrode electrically connected to the second driving node, and a fourth transistor having a gate electrode electrically connected to the second clock line, one electrode electrically connected to the first power line, and another electrode electrically connected to the second driving node.

The third transistor may include a third sub transistor having a gate electrode electrically connected to the first driving node, and one electrode electrically connected to the second clock line, and a fourth sub transistor having a gate electrode electrically connected to the first driving node, one electrode electrically connected to another electrode of the third sub transistor, and another electrode electrically connected to the second driving node.

The second driving circuit may include a fifth transistor having a gate electrode connected to the second driving node, one electrode connected to the first power line, and another electrode connected to the other electrode of the third sub transistor.

The output circuit included in the n-th scan stage may include a sixth transistor having a gate electrode electrically connected to the first driving node, one electrode electrically connected to a first clock line that provides the first clock signal, and another electrode electrically connected to an n-th scan line that outputs the scan signal, and a seventh transistor having a gate electrode electrically connected to the first driving node, one electrode electrically connected to the first clock line, and another electrode electrically connected to an n-th carry line that outputs the carry signal.

The output circuit included in the n-th scan stage may include a first capacitor having one electrode electrically connected to the gate electrode of the sixth transistor and another electrode electrically connected to the n-th scan line.

The output circuit included in the n-th scan stage may include an eighth transistor having a gate electrode electrically connected to the second driving node, one electrode electrically connected to a second power line that provides the second voltage, and another electrode electrically connected to the n-th scan line, and a ninth transistor having a gate electrode electrically connected to the second driving node, one electrode electrically connected to a third power line that provides a third voltage, and another electrode electrically connected to the n-th carry line.

The output circuit included in the n-th scan stage may include a second capacitor having one electrode electrically connected to the second driving node and another electrode electrically connected to the second power line.

The output circuit included in the n-th scan stage may include a second capacitor having one electrode electrically connected to the second driving node and another electrode electrically connected to the third power line.

The n-th scan stage may include a tenth transistor having a gate electrode electrically connected to a first clock line that provides the first clock signal, and one electrode electrically connected to the first driving node, and an eleventh transistor having a gate electrode electrically connected to the second driving node, one electrode electrically connected to another electrode of the tenth transistor, and another electrode electrically connected to an n-th carry line that outputs the carry signal.

A scan driver according to an embodiment may include a plurality of scan stages. An n-th scan stage among the plurality of scan stages may include a first driving circuit that controls a voltage of a first driving node based on an input signal and a second clock signal that is any one of a scan start signal and a previous carry signal, a second driving circuit that controls a voltage of a second driving node based on the second clock signal and a first voltage, and an output circuit that outputs a first clock signal as a scan signal and a carry signal, based on the voltage of the first driving node, and outputs a second voltage as the scan signal and the carry signal, based on the voltage of the second driving node. The first driving circuit may include a first transistor having a gate electrode electrically connected to a second clock line that provides the second clock signal, one electrode electrically connected to an input line that provides the input signal, and another electrode electrically connected to the first driving node. Here, n may be a natural number equal to or greater than one.

Each of the plurality of scan stages may be electrically connected to two clock lines among a first clock line that provides the first clock signal, the second clock line, a third clock line that provides a third clock signal, and a fourth clock line that provides a fourth clock signal.

The first clock signal, the second clock signal, the third clock signal, and the fourth clock signal may be set at a same period, the second clock signal may be delayed by a phase difference of a ½ period from the first clock signal, the third clock signal may be delayed by a phase difference of a ¼ period from the first clock signal, and the fourth clock signal may be delayed by a phase difference of a ½ period from the third clock signal.

An m-th scan stage among the plurality of scan stages may be electrically connected to the first clock line and the second clock line, and an (m+1)-th scan stage among the first to p-th scan stages may be electrically connected to the third clock line and the fourth clock line. Here, m may be a natural number equal to or greater than one.

The first transistor may include a first sub transistor having a gate electrode electrically connected to the second clock line, and one electrode electrically connected to the input line, and a second sub transistor having a gate electrode electrically connected to the second clock line, one electrode electrically connected to the other electrode of the first sub transistor, and another electrode electrically connected to the first driving node, and the first driving circuit may include a second transistor having a gate electrode electrically connected to the first driving node, one electrode electrically connected to a first power line that provides the first voltage, and another electrode electrically connected to the other electrode of the first sub transistor.

The scan driver according to the disclosure may simplify the scan stage circuit by reducing the number of transistors included in the scan stage and removing a line required for reset in the scan stage.

BRIEF DESCRIPTION OF THE DRAWINGS

The above and other features will become more apparent by describing in further detail embodiments thereof with reference to the accompanying drawings, in which.

DETAILED DESCRIPTION OF THE EMBODIMENTS

Figure 1:
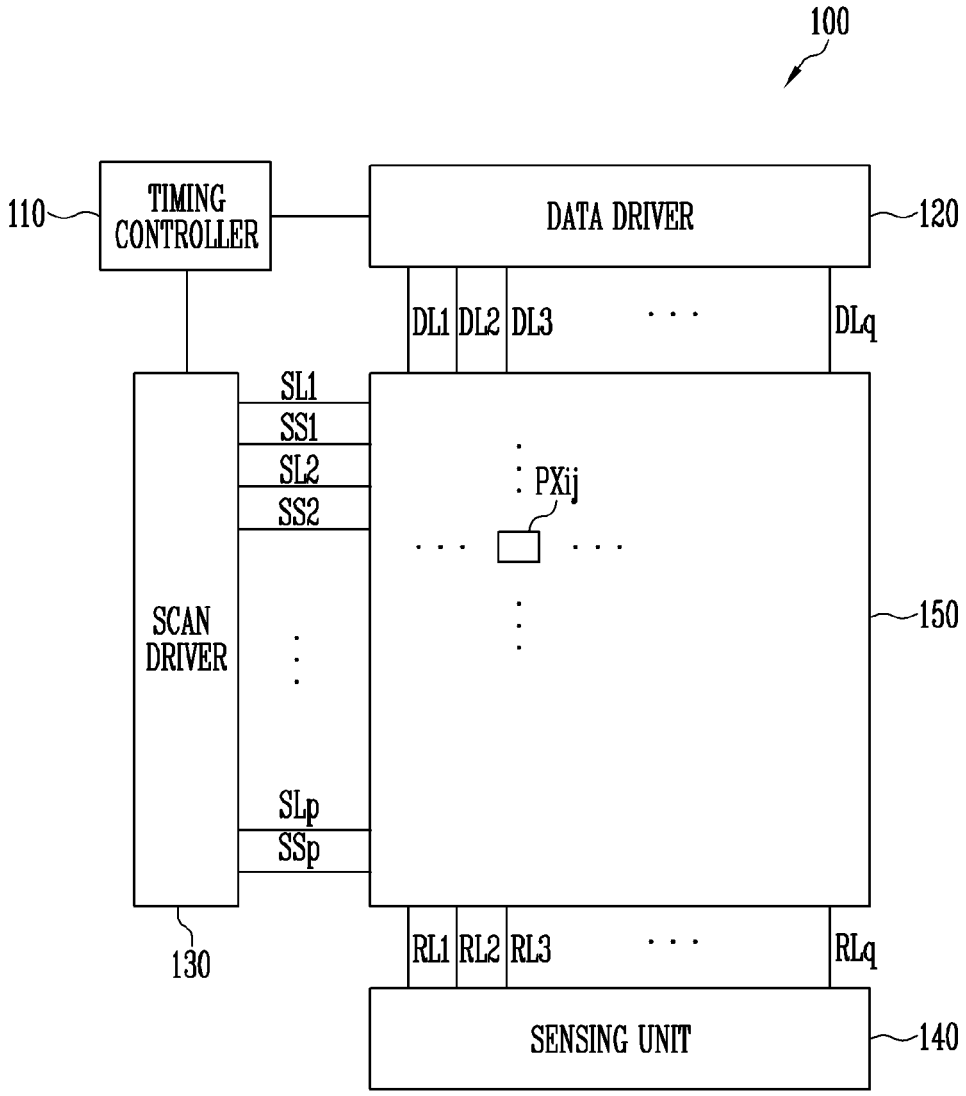
FIG. 1 is a diagram illustrating a display device according to an embodiment.

Although the disclosure may be modified in various manners and have additional embodiments, embodiments are illustrated in the accompanying drawings and will be mainly described in the specification. However, the scope of the disclosure is not limited to the embodiments in the accompanying drawings and the specification and should be construed as including all of the changes, equivalents, and substitutions included in the spirit and scope of the disclosure.

In order to clearly describe the disclosure, parts that are not related to the description are omitted, and the same or similar components are denoted by the same reference numerals throughout the specification. Therefore, the above-described reference numerals may be used in other drawings.

In addition, sizes and thicknesses of elements shown in the drawings are arbitrarily shown for convenience of description, and thus the disclosure is not necessarily limited to those shown in the drawings. In the drawings, thicknesses may be exaggerated to clearly express various layers and regions.

Further, in the specification, the phrase "in a plan view" means when an object portion is viewed from above, and the phrase "in a schematic cross-sectional view" means when a schematic cross-section taken by vertically cutting an object portion is viewed from the side. In addition, in this specification, the phrase "on a plane" means viewing a target portion from the top.

Additionally, the terms "overlap" or "overlapped" mean that a first object may be above or below or to a side of a second object, and vice versa. Additionally, the term "overlap" may include layer, stack, face or facing, extending over, covering or partly covering or any other suitable term as would be appreciated and understood by those of ordinary skill in the art. The terms "face" and "facing" mean that a first element may directly or indirectly oppose a second element. In a case in which a third element intervenes between the first and second element, the first and second element may be understood as being indirectly opposed to one another, although still facing each other. When an element is described as 'not overlapping' or 'to not overlap' another element, this may include that the elements are spaced apart from each other, offset from each other, or set aside from each other or any other suitable term as would be appreciated and understood by those of ordinary skill in the art.

It will be understood that when an element such as a layer, film, region, substrate, or area is referred to as being "on" another element, it may be directly on the other element or intervening elements may also be present. In contrast, when an element is referred to as being "directly on" another element, intervening elements may be absent therebetween.

Further when a layer, film, region, substrate, or area, is referred to as being "below" another layer, film, region, substrate, or area, it may be directly below the other layer, film, region, substrate, or area, or intervening layers, films, regions, substrates, or areas, may be present therebetween. Conversely, when a layer, film, region, substrate, or area, is referred to as being "directly below" another layer, film, region, substrate, or area, intervening layers, films, regions, substrates, or areas, may be absent therebetween. Further, "over" or "on" may include positioning on or below an object and does not necessarily imply a direction based upon gravity.

The spatially relative terms "below", "beneath", "lower", "above", "upper", or the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in other directions and thus the spatially relative terms may be interpreted differently depending on the orientations.

Throughout the specification, when an element is referred to as being "connected" to another element, the element may be "directly connected" to another element, or "electrically connected" to another element with one or more intervening elements interposed therebetween. It will be further understood that when the terms "comprises," "comprising," "includes" and/or "including" are used in this specification, they or it may specify the presence of stated features, integers, steps, operations, elements and/or components, but do not preclude the presence or addition of other features, integers, steps, operations, elements, components, and/or any combination thereof.

Although the terms "first," "second," and the like are used for describing various components, these components are not confined by these terms. These terms are merely used for distinguishing one component from the other components. Therefore, a first component may be a second component or vice versa according within the spirit and scope of the disclosure.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

In the specification and the claims, the term "and/or" is intended to include any combination of the terms "and" and "or" for the purpose of its meaning and interpretation. For example, "A and/or B" may be understood to mean "A, B, or A and B." The terms "and" and "or" may be used in the conjunctive or disjunctive sense and may be understood to be equivalent to "and/or." In the specification and the claims, the phrase "at least one of" is intended to include the meaning of "at least one selected from the group of" for the purpose of its meaning and interpretation. For example, "at least one of A and B" may be understood to mean "A, B, or A and B."

Unless otherwise defined, all terms used herein (including technical and scientific terms) have the same meaning as commonly understood by those skilled in the art to which this disclosure pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the specification.

FIG. 1 is a diagram illustrating a display device according to an embodiment.

Referring to FIG. 1, the display device 100 may include a timing controller 110, a data driver 120, a scan driver 130, a sensing unit 140, and a pixel unit 150.

The timing controller 110 may provide grayscale values, a control signal, or the like to the data driver 120. For example, the timing controller 110 may provide a clock signal, a control signal, or the like to each of the scan driver 130 and the sensing unit 140.

The data driver 120 may generate data signals using the grayscale values, the control signal, or the like received from the timing controller 110. For example, the data driver 120 may sample the grayscale values using a clock signal and apply the data signals corresponding to the grayscale values to data lines DL1 to DLq (where q may be a natural number) in a pixel row unit.

The scan driver 130 may receive the clock signal, the control signal, or the like from the timing controller 110 and generate scan signals to be provided to scan lines SL1, SL2, . . . , and SLp (where p may be a natural number). For example, the scan driver 130 may sequentially provide scan signals having a pulse of a turn-on level to the scan lines SL1, SL2, . . . , and SLp. For example, the scan driver 130 may generate the scan signals in a manner of sequentially transferring a pulse of a turn-on level to a next scan stage according to the clock signal. For example, the scan driver 130 may be in a form of a shift register.

The clock signal provided to the scan driver 130 may include first to fourth clock signals. The scan driver 130 may receive another clock signal in addition to the first to fourth clock signals described above. The first to fourth clock signals will be described later with reference to FIGS. 3 and 5.

For example, the scan driver 130 may generate sensing signals to be provided to sensing lines SS1, SS2, . . . , and SSp. For example, the scan driver 130 may sequentially provide the sensing signals having a pulse of a turn-on level to the sensing lines SS1, SS2, . . . , and SSp. For example, the scan driver 130 may generate the sensing signals in a manner of sequentially transferring a pulse of a turn-on level to a next scan stage according to the clock signal.

The sensing unit 140 may measure deterioration information of pixels according to a current or a voltage received through reception lines RL1, RL2, RL3, . . . , and RLq. For example, the deterioration information of the pixels may be mobility information and threshold voltage information of driving transistors, deterioration information of a light emitting element, and the like. For example, the sensing unit 140 may measure characteristic information of the pixels according to an environment, in accordance with the current or the voltage received through the reception lines RL1, RL2, RL3, . . . , and RLq. For example, the sensing unit 140 may also measure changed characteristic information of the pixels according to temperature or humidity.

The pixel unit 150 may include pixels. Each pixel Pxij (where i may be a natural number equal to or greater than one and equal to or less than p, and j may be a natural number equal to or greater than one and equal to or less than q) may be electrically connected to a corresponding data line, scan line, sensing line, and reception line. The pixel PXij may refer to a pixel circuit in which a scan transistor may be electrically connected to an i-th scan line and a j-th data line.

Figure 2:
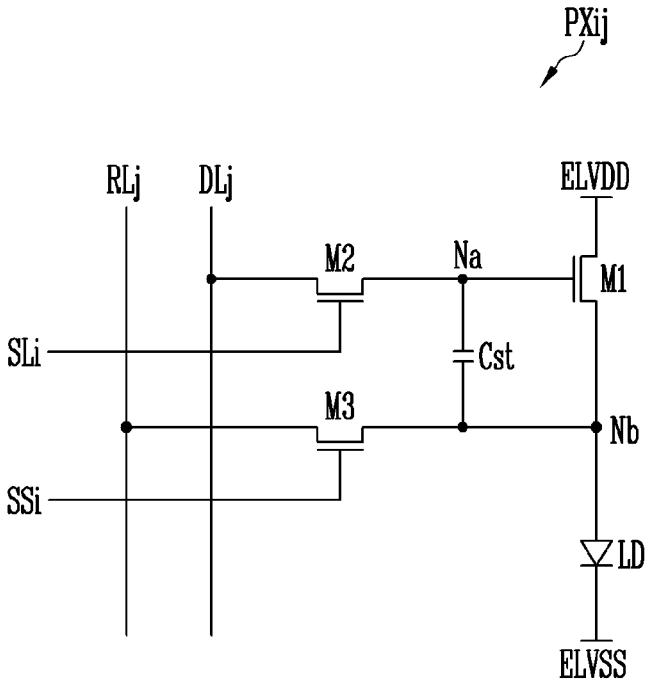
FIG. 2 is an equivalent circuit diagram illustrating an example of a pixel included in the display device of FIG. 1.

FIG. 2 is an equivalent circuit diagram illustrating an example of the pixel included in the display device of FIG. 1.

Referring to FIG. 2, the pixel PXij may include thin film transistors M1, M2, and M3 (or transistors), a storage capacitor Cst, and a light emitting element LD. The thin film transistors M1, M2, and M3 may be N type transistors. However, the disclosure is not limited thereto.

In the first thin film transistor M1, a gate electrode may be electrically connected to a gate node Na, one electrode (or a first electrode) may be electrically connected to a power line ELVDD, and another electrode (or a second electrode) may be electrically connected to a source node Nb. The first thin film transistor M1 may be referred to as a driving transistor. However, the disclosure is not limited thereto.

In the second thin film transistor M2, a gate electrode may be electrically connected to the scan line SLi, one electrode may be electrically connected to the data line DLj, and another electrode may be electrically connected to the gate node Na. The second thin film transistor M2 may be referred to as a switching transistor, a scan transistor, or the like.

In the third thin film transistor M3, a gate electrode may be electrically connected to the sensing line SSi, one electrode may be electrically connected to the reception line RLj, and another electrode may be electrically connected to the source node Nb. The third thin film transistor M3 may be referred to as an initialization transistor, a sensing transistor, or the like.

In the storage capacitor Cst, one electrode may be electrically connected to the gate node Na, and another electrode may be electrically connected to the source node Nb.

In the light emitting element LD, an anode may be electrically connected to the source node Nb and a cathode may be electrically connected to a power line ELVSS. The light emitting element LD may be an organic light emitting diode, an inorganic light emitting diode, or the like.

Figure 3:
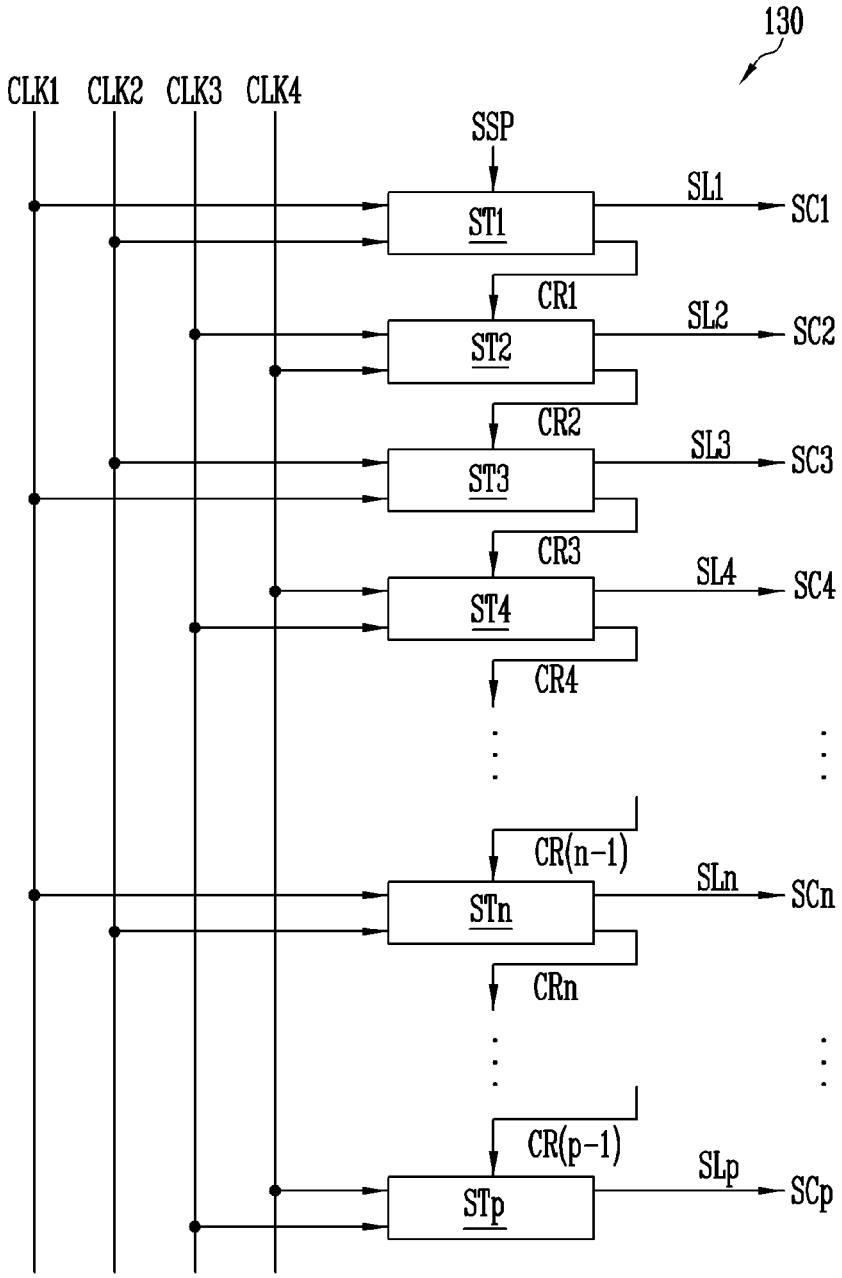
FIG. 3 is a diagram illustrating an example of a scan driver included in the display device of FIG. 1.

FIG. 3 is a diagram illustrating an example of the scan driver included in the display device of FIG. 1.

Referring to FIG. 3, the scan driver 130 may include scan stages ST1, ST2, ST3, ST4, . . . , STn, . . . , and STp (where n may be a natural number equal to or greater than one and equal to or less than p). In FIG. 3, a part of the scan driver 130 necessary for description is shown.

Each of the scan stages ST1, ST2, ST3, ST4, . . . , STn, . . . , and STp may be electrically connected to a corresponding clock line among corresponding first to fourth clock lines CLK1, CLK2, CLK3, and CLK4. In an embodiment, each of the scan stages ST1, ST2, ST3, ST4, . . . , STn, . . . , and STp may be electrically connected to two clock lines among the first to fourth clock lines CLK1, CLK2, CLK3, and CLK4.

In an embodiment, when an m-th (m may be a natural number less than p) scan stage among the first to p-th scan stages may be electrically connected to the first clock line CLK1 and the second clock line CLK2, an (m+1)-th scan stage may be electrically connected to the third clock line CLK3 and the fourth clock line CLK4. For example, the first scan stage ST1 may be electrically connected to the first clock line CLK1 and the second clock line CLK2, the second scan stage ST2 may be electrically connected to the third clock line CLK3 and the fourth clock CLK4, the third scan stage ST3 may be electrically connected to the first clock line CLK1 and the second clock line CLK2, and the fourth scan stage ST4 may be electrically connected to the third clock line CLK3 and the fourth clock line CLK4. For example, the n-th scan stage STn may be electrically connected to the first clock line CLK1 and the second clock line CLK2, and the p-th scan stage STp may be electrically connected to the third clock line CLK3 and the fourth clock line CLK4. As described above, odd-numbered scan stages ST1, ST3, . . . may be electrically connected to the first clock line CLK1 and the second clock line CLK2, and even-numbered scan stages ST2, ST4, . . . may be electrically connected to the third clock line CLK3 and the fourth clock line CLK4.

However, a connection relationship between the clock lines and the scan stages is not limited thereto. For example, the odd-numbered scan stages ST1, ST3, . . . may be electrically connected to the third clock line CLK3 and the fourth clock line CLK4, and the even-numbered scan stages ST2, ST4, . . . may be electrically connected to the first clock line CLK1 and the second clock line CLK2.

For example, the scan driver 130 may include other clock lines in addition to the first to fourth clock lines CLK1, CLK2, CLK3, and CLK4. For example, the scan driver 130 may include a fifth clock line and a sixth clock line. In this case, the first scan stage ST1 may be electrically connected to the first clock line CLK1 and the second clock line CLK2, the second scan stage ST2 may be electrically connected to the third clock line CLK3 and the fourth clock line, and the third scan stage ST3 may be electrically connected to the fifth clock line and the sixth clock line.

Clock signals for each of the scan stages ST1 to STp may be applied to the first to fourth clock lines CLK1 to CLK4. For example, a first clock signal may be applied to the first clock line CLK1, a second clock signal may be applied to the second clock line CLK2, a third clock signal may be applied to the third clock line CLK3, and a fourth clock signal may be applied to the fourth clock line CLK4. The first to fourth clock signals will be described later with reference to FIG. 5.

The scan stages ST1 to STp may be electrically connected to corresponding lines among the scan lines SL1 to SLp and carry lines CR1 to CR(p−1).

For example, the first scan stage ST1 may be electrically connected to the first scan line SL1 and the first carry line CR1, the second scan stage ST2 may be electrically connected to the second scan line SL2 and the second carry line CR2, the third scan stage ST3 may be electrically connected to the third scan line SL3 and the third carry line CR3, the fourth scan stage ST4 may be electrically connected to the fourth scan line SL4 and the fourth carry line CR4, and the n-th scan stage STn may be electrically connected to the n-th scan line SLn and the n-th carry line CRn. Alternatively, since the scan driver 130 may not include a next scan stage (for example, a (p+1)-th scan stage) to which the p-th scan stage STp may transfer a carry signal, the p-th scan stage STp may be electrically connected to only the p-th scan line SLp.

Output signals generated by the respective scan stages ST1 to STp may be applied to the scan lines SL1 to SLp and the carry lines CR1 to CR(p−1).

For example, the scan stages ST1 to STp may be electrically connected to an input line that may provide an input signal that may be any one of a scan start signal and a previous carry signal. The input line may include a scan start line SSP that may provide a scan start signal, and the carry lines CR1 to CR(p−1).

In an embodiment, the first scan stage ST1 may be electrically connected to the scan start line SSP, an r-th (r may be a natural number equal to or greater than two and equal to or less than p) scan stage may be electrically connected to an (r−1)-th carry line that may provide a carry signal output from an (r−1)-th scan stage. For example, the second scan stage ST2 may be electrically connected to the first carry line CR1, the third scan stage ST3 may be electrically connected to the second carry line CR2, the fourth scan stage ST4 may be electrically connected to the third carry line CR3, the n-th scan stage STn may be electrically connected to the (n−1)-th carry line CR(n−1), and the p-th scan stage STp may be electrically connected to the (p−1)-th carry line CR(p−1).

When the display device performs an operation of displaying an image or images, the scan driver 130 may sequentially apply the scan signal to the first to p-th scan lines SL1 to SLp in response to the scan start signal provided through the scan start line SSP. In other words, the scan start signal applied to the first scan stage ST1 may control a start timing of the scan signal output from the scan driver 130. For example, the first scan stage ST1 may output a first scan signal SC1 through the first scan line SL1 in response to the scan start signal, the second scan stage ST2 may output a second scan signal SC2 through the second scan line SL2 in response to the first carry signal after the first scan stage ST1 outputs the first scan signal SC1, the third scan stage ST3 may output a third scan signal SC3 through the third scan line SL3 in response to the second carry signal after the second scan stage ST2 outputs the second scan signal SC2, the fourth scan stage ST4 may output a fourth scan signal SC4 through the fourth scan line SL4 in response to the third carry signal after the third scan stage ST3 outputs the third scan signal SC3, the n-th scan stage STn may output an n-th scan signal SCn through the n-th scan line SLn in response to the (n−1)-th carry signal after the (n−1)-th scan stage outputs the (n−1)-th scan signal, and the p-th scan stage STp may output a p-th scan signal SCp through the p-th scan line SLn in response to the (p−1)-th carry signal after the (p−1)-th scan stage outputs the (p−1)-th scan signal.

Figure 4:
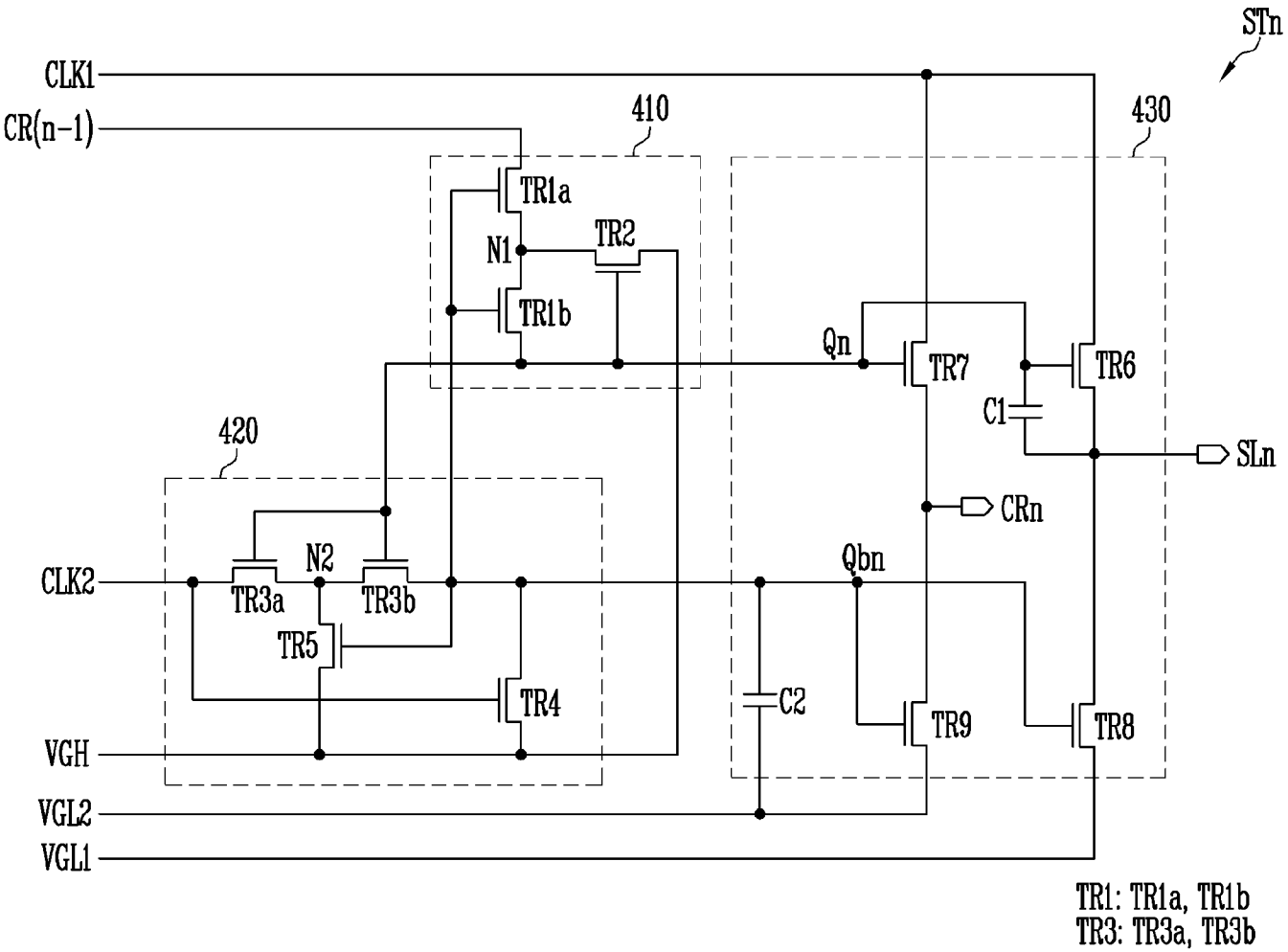
FIG. 4 is an equivalent circuit diagram illustrating an example of an n-th scan stage included in the scan driver of FIG. 3.

FIG. 4 is an equivalent circuit diagram illustrating an example of the n-th scan stage included in the scan driver of FIG. 3.

Referring to FIG. 4, the n-th scan stage STn may include a first driving circuit 410, a second driving circuit 420, and an output circuit 430. The other scan stages ST1, ST2, ST3, ST4, . . . , and STp described with reference to FIG. 3 may include a configuration substantially the same as the n-th scan stage STn.

The n-th scan stage STn may include transistors TR1 to TR9 and capacitors C1 and C2. Hereinafter, the description will be given according to an example that the transistors TR1 to TR9 are N type transistors (for example, NMOS), but those skilled in the art may modify the scan stage by replacing some or all of the transistors TR1 to TR9 with a P type transistor (for example, PMOS).

The first driving circuit 410 may include the first transistor TR1 and the second transistor TR2. The first driving circuit 410 may control a voltage of a first driving node Qn, based on the input signal that may be any one of the scan start signal and the previous carry signal, and a voltage of a second driving node Qbn. This will be described later with reference to FIGS. 3 to 5.

In the first transistor TR1, a gate electrode may be electrically connected to the second driving node Qbn, an electrode may be electrically connected to the (n−1)-th carry line CR(n−1), and another electrode may be electrically connected to the first driving node Qn.

However, as described with reference to FIG. 3, the first scan stage ST1 may be electrically connected to the scan start line SSP (refer to FIG. 3). Therefore, an electrode of the first transistor TR1 included in the first scan stage ST1 may be electrically connected to the scan start line SSP (refer to FIG. 3).

In an embodiment, the first transistor TR1 may include a first sub transistor TR1*a* and a second sub transistor TR1*b* that may be electrically connected in series. In the first sub-transistor TR1*a*, a gate electrode may be electrically connected to the second driving node Qbn, an electrode may be electrically connected to the (n−1)-th carry line CR(n−1), and another electrode may be electrically connected to a first node N1 (or an electrode of the second sub transistor TR1*b*). In the second sub transistor TR1*b*, a gate electrode may be electrically connected to the second driving node Qbn, an electrode may be electrically connected to the first node N1, and another electrode may be electrically connected to the first driving node Qn.

In the second transistor TR2, a gate electrode may be electrically connected to the first driving node Qn, an electrode may be electrically connected to a first power line VGH that may provide a first voltage, and another electrode may be electrically connected to the first node N1 (or another electrode of the first sub transistor).

The second driving circuit 420 may include the third transistor TR3, the fourth transistor TR4, and the fifth transistor TR5. The second driving circuit 420 may control a voltage of the second driving node Qbn, based on the second clock signal provided through the second clock line CLK2 and the first voltage provided through the first power line VGH. This will be described later with reference to FIGS. 3 to 5.

In the third transistor TR3, a gate electrode may be electrically connected to the first driving node Qn, an electrode may be electrically connected to the second clock line CLK2, and another electrode may be electrically connected to the second driving node Qbn.

In an embodiment, the third transistor TR3 may include a third sub transistor TR3*a* and a fourth sub transistor TR3*b* that may be electrically connected in series. In the third sub transistor TR3*a*, a gate electrode may be electrically connected to the first driving node Qn, an electrode may be electrically connected to the second clock line CLK2, and another electrode may be electrically connected to a second node N2 (or an electrode of the four sub transistors TR3*b*). In the fourth sub transistor TR3*b*, a gate electrode may be electrically connected to the first driving node Qn, another electrode may be electrically connected to the second node N2, and another electrode may be electrically connected to the second driving node Qbn.

In the fourth transistor TR4, a gate electrode may be electrically connected to the second clock line CLK2, an electrode may be electrically connected to the first power line VGH, and another electrode may be electrically connected to the second driving node Qbn.

In the fifth transistor TR5, a gate electrode may be electrically connected to the second driving node Qbn, an electrode may be electrically connected to the first power line VGH, and another electrode may be electrically connected to the second node N2 (or another electrode of the third sub transistor TR3*a*).

The output circuit 430 may include the sixth transistor TR6, the seventh transistor TR7, the eighth transistor TR8, the ninth transistor TR9, the first capacitor C1, and the second capacitor C2. The output circuit 430 may output the first clock signal provided through the first clock line CLK1 as the n-th scan signal and the n-th carry signal, based on the voltage of the first driving node Qn, and output a second voltage provided through a second power line VGL1 or a third voltage provided through a third power line VGL2 as the n-th scan signal and the n-th carry signal, based on the voltage of the second driving node Qbn. This will be described later with reference to FIGS. 3 to 5.

In the sixth transistor TR6, a gate electrode may be electrically connected to the first driving node Qn, an electrode may be electrically connected to the first clock line CLK1, and another electrode may be electrically connected to the n-th scan line SLn.

In the first capacitor C1, an electrode may be electrically connected to the gate electrode of the sixth transistor TR6 and another electrode may be electrically connected to the n-th scan line SLn.

In the seventh transistor TR7, a gate electrode may be electrically connected to the first driving node Qn, an electrode may be electrically connected to the first clock line CLK1, and another electrode may be electrically connected to the n-th carry line CRn.

In the eighth transistor TR8, a gate electrode may be electrically connected to the second driving node Qbn, an electrode may be electrically connected to the second power line VGL1, and another electrode may be electrically connected to the n-th scan line SLn.

In the ninth transistor TR9, a gate electrode may be electrically connected to the second driving node Qbn, an electrode may be electrically connected to the third power line VGL2, and another electrode may be electrically connected to the n-th carry line CRn.

In the second capacitor C2, an electrode may be electrically connected to the second driving node Qbn and another electrode may be electrically connected to the third power line VGL2. In FIG. 4, the other electrode of the second capacitor C2 may be electrically connected to the third power line VGL2, but this is an example, and the disclosure not limited thereto. For example, in the second capacitor C2, an electrode may be electrically connected to the second driving node Qbn and another electrode may be electrically connected to the second power line VGL1.

In FIG. 4, the n-th scan stage STn may be electrically connected to the first clock line CLK1 and the second clock line CLK2. However, as described with reference to FIG. 3, this is an example, and the disclosure is not limited thereto. For example, the n-th scan stage STn may be electrically connected to the third clock line CLK3 (refer to FIG. 3) and the fourth clock line CLK4 (refer to FIG. 3).

As an example, in FIG. 4, an electrode of the seventh transistor TR7 and an electrode of the eighth transistor TR8 may be electrically connected to the first clock line CLK1, and another electrode of the third transistor TR3 and the gate electrode of the fourth transistor TR4 may be electrically connected to the second clock line CLK2. However, this is an example, and the disclosure is not limited thereto. For example, an electrode of the seventh transistor TR7 and an electrode of the eighth transistor TR8 may be electrically connected to the second clock line CLK2, and an electrode of the third transistor TR3 and the gate electrode of the fourth transistor TR4 may be electrically connected to the first clock line CLK1.

Similarly, when the n-th scan stage STn may be electrically connected to the third clock line CLK3 (refer to FIG. 3) and the fourth clock line CLK4 (refer to FIG. 3) as described above, an electrode of the seventh transistor TR7 and an electrode of the eighth transistor TR8 may be electrically connected to the third clock line CLK3 (refer to FIG. 3), and an electrode of the third transistor TR3 and the gate electrode of the fourth transistor TR4 may be electrically connected to the fourth clock lines CLK4 (refer to FIG. 3). Alternatively, an electrode of the seventh transistor TR7 and an electrode of the eighth transistor TR8 may be electrically connected to the fourth clock lines CLK4 (refer to FIG. 3), and an electrode of the third transistor TR3 and the gate electrode of the fourth transistor TR4 may be electrically connected to the third clock line CLK3 (refer to FIG. 3).

Figure 5:
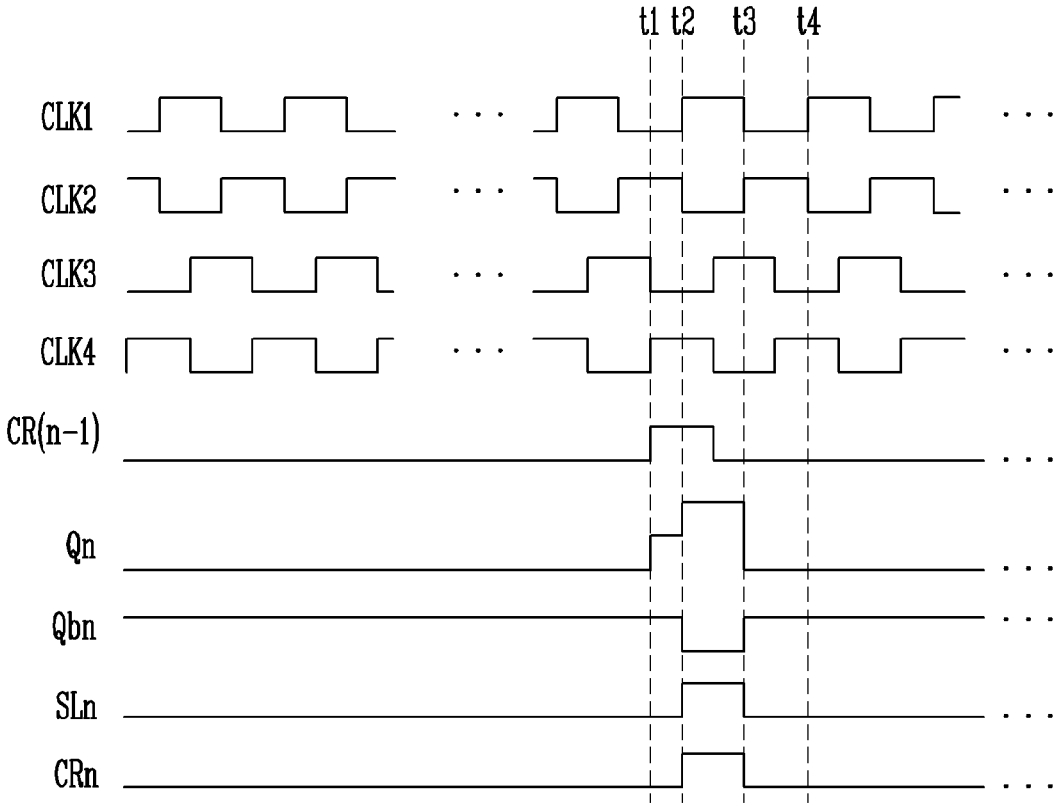
FIG. 5 is a waveform diagram illustrating a driving method of the scan driver of FIG. 3.

FIG. 5 is a waveform diagram illustrating a driving method of the scan driver of FIG. 3.

Referring to FIGS. 3 to 5, signals applied to the first clock line CLK1, the second clock line CLK2, the third clock line CLK3, the fourth clock line CLK4, the (n−1)-th carry line CR(n−1)), the first driving node Qn, the second driving node Qbn, the n-th scan line SLn, and the n-th carry line CRn are shown.

It is to be understood that the numbering and type of the transistors is arbitrary. In addition, it is to be understood that the numbering and type of the transistors in the first driving circuit 410, the second driving circuit 420, and the output circuit 430 is arbitrary.

FIG. 5 illustrates first to fourth clock signals applied to the first to fourth clock lines CLK1 to CLK4.

The first clock signal applied to the first clock line CLK1, the second clock signal applied to the second clock line CLK2, the third clock signal applied to the third clock line CLK3, and the fourth clock signal applied to the fourth clock line CLK4 may have a same period. In an embodiment, a length (or width) of a period of pulses of a high level (or logic high level) of each of the first to fourth clock lines CLK1 to CLK4 may be the same as a length (or width) of a period of pulses of a low level (or logic low level) of each of the first to fourth clock lines CLK1 to CLK4. The high level (or logic high level) may correspond to a voltage level sufficient to turn on the transistor, and the low level (or logic low level) may correspond to a voltage level sufficient to turn off the transistor.

In an embodiment, the second clock signal applied to the second clock line CLK2 may be delayed in phase from that of the first clock signal applied to the first clock line CLK1. For example, the second clock signal may be delayed by a phase difference of a ½ period from the first clock signal. Therefore, a falling edge of the second clock signal may be positioned adjacent to a rising edge of the first clock signal, and a rising edge of the second clock signal may be positioned adjacent to a falling edge of the first clock signal. Thus, a period during which the first clock signal has high level pulses and a period during which the second clock signal has high level pulses may not overlap each other.

For example, the third clock signal applied to the third clock line CLK3 may be delayed in phase from that of the first clock signal applied to the first clock line CLK1. For example, the third clock signal may be delayed by a phase difference of a ¼ period from the first clock signal.

For example, the fourth clock signal applied to the fourth clock line CLK4 may be delayed in phase from that of the third clock signal applied to the third clock line CLK3. For example, the fourth clock signal may be delayed by a phase difference of a ½ period from the third clock signal. Similarly, a falling edge of the fourth clock signal may be positioned adjacent to a rising edge of the third clock signal, and a rising edge of the fourth clock signal may be positioned adjacent to a falling edge of the third clock signal. Therefore, a period during which the third clock signal has high level pulses and a period during which the fourth clock signal has high level pulses may not overlap each other.

Hereinafter, an operation of the n-th scan stage STn will be described with reference to FIGS. 3 to 5. Since operations of the first to p-th scan stages ST1 to STp may be substantially the same or similar to each other, the operation of the n-th scan stage STn will be described by encompassing the first to p-th scan stages ST1 to STp.

When a pulse of a high level may be applied to the second clock line CLK2, the fourth transistor TR4 may be turned on and the second driving node Qbn may be charged to a first voltage of a high level provided through the first power line VGH.

At a first time point t1, a pulse of a high level may be applied to the (n−1)-th carry line CR(n−1). For example, a voltage of a high level may be maintained at the second driving node Qbn. In this case, since the first sub transistor TR1*a* and the second sub transistor TR1*b* may be turned on or maintain a turn-on state, the first driving node Qn may be charged to the high level applied to the (n−1)-th carry line CR(n−1). Therefore, the third sub transistor TR3*a* and the fourth sub transistor TR3*b* may be turned on. Since a pulse of a high level may be applied to the second clock line CLK2, a voltage of a high level may be maintained at the second driving node Qbn.

At the first time point t1, the sixth transistor TR6 and the seventh transistor TR7 may be turned on in response to a voltage of a high level of the first driving node Qn.

At a second time point t2, a signal of a low level may be applied to the second clock line CLK2. Since the third sub transistor TR3*a* and the fourth sub transistor TR3*b* are turned on or maintain a turn-on state in response to a voltage of the high level of the first driving node Qn, the second driving node Qbn may be discharged to the low level applied to the second clock line CLK2. Therefore, the first sub transistor TR1*a* and the second sub transistor TR1*b* may be turned off, and the eighth transistor TR8 and the ninth transistor TR9 may be turned off.

As an example, at the second time point t2, a pulse of a high level may occur in the first clock line CLK1. In this case, the voltage of the first driving node Qn may be boosted higher than the high level by the first capacitor C1, and a pulse of a high level may be applied to the n-th scan line SLn and the n-th carry line CRn.

When the first driving node Qn is charged (or boosted higher than the high level) to the voltage of the high level, the second transistor TR2 may be turned on. Therefore, the first node N1 may be charged to the first voltage of the high level provided through the first power line VGH.

For example, a drain-source voltage of the first sub transistor TR1*a* (for example, a voltage between an electrode and another electrode of the first sub transistor TR1*a*) may be a difference between a voltage of the (n−1)-th carry signal and a voltage of the first node N1 (or a first voltage). For example, a drain-source voltage of the second sub transistor TR1*b* (for example, a voltage between an electrode and another electrode of the second sub transistor TR1*b*) may be a difference between the voltage of the first node N1 (or a first voltage) and the voltage of the first driving node Qn.

For example, in a period in which the voltage of the first driving node Qn is boosted higher than the high level and the (n−1)-th carry signal of the low level is applied to the (n−1)-th carry line CR(n−1), when the voltage of the first driving node Qn is boosted to about 20V, the voltage of the first node N1 (or a first voltage) may be about 10V, and the voltage of the (n−1)-th carry signal may be about −7V, the drain-source voltage of the first sub transistor TR1*a* may be about 17V, and the drain-source voltage of the second sub transistor TR1*b* may be about 10V.

Therefore, since the voltage of the high level may be applied to the first node N1 through the second transistor TR2, the drain-source voltage of the first sub transistor TR1*a* and the second sub transistor TR1*b* may not be relatively large despite the voltage boosting of the first driving node Qn. Similarly, in a period in which the voltage of the second driving node Qbn may be the high level and the signal of the low level may be applied to the second clock line CLK2, since the voltage of the high level may be applied to the second node N2 through the fifth transistor TR5, the drain-source voltage of the third sub transistor TR3*a* and the fourth sub transistor TR3*b* may not be relatively large. Therefore, deterioration of the transistors TR1*a*, TR1*b*, TR3*a*, and TR3*b* may be prevented.

At a third time point t3, a pulse of a high level may occur in the second clock line CLK2. In this case, the second driving node Qbn may be charged to the high level applied to the second clock line CLK2. Therefore, the first sub transistor TR1*a* and the second sub transistor TR1*b* may be turned on. In this case, since the (n−1)-th carry signal of the low level may be applied to the (n−1)-th carry line CR(n−1), the first driving node Qn may be discharged to the low level applied to the (n−1)-th carry line CR(n−1).

At a fourth time point t4, a pulse of a high level may occur in the first clock line CLK1. However, after the third time point t3, since the low level is maintained at the (n−1)-th carry line CR(n−1), the first driving node Qn may maintain the voltage of the low level according to the low level applied to the (n−1)-th carry line CR(n−1). Therefore, the sixth transistor TR6 and the seventh transistor TR7 may be turned off or maintain a turn-off state. As an example, the eighth transistor TR8 and the ninth transistor TR9 may be turned on or maintain a turn-on state in response to the voltage of the high level of the second driving node Qbn, and the n-th scan line SLn and the n-th carry line CRn may be electrically connected to the second power line VGL1 that may provide the second voltage of a low level and the third power line VGL2 that may provide the third voltage of a low level, respectively. Therefore, a pulse of a high level may not be output to the n-th scan line SLn and the n-th carry line CRn.

As described with reference to FIGS. 3 to 5, the first driving circuit 410 including the first transistor TR1 may control the voltage of the first driving node Qn, based on the input signal of any one of the scan start signal and the previous carry signal, and the voltage of the second driving node Qbn. By way of example, the first driving circuit 410 may charge and discharge the first driving node Qn through the first transistor TR1. Therefore, the first to n-th scan stages ST1 to STn may not include a separate reset line and a separate transistor for discharging the first driving node Qn. A dummy line for discharging the first driving node Qn of the p-th scan stage STp may not be included. Therefore, the scan stage circuit may be simplified.

Figure 6:
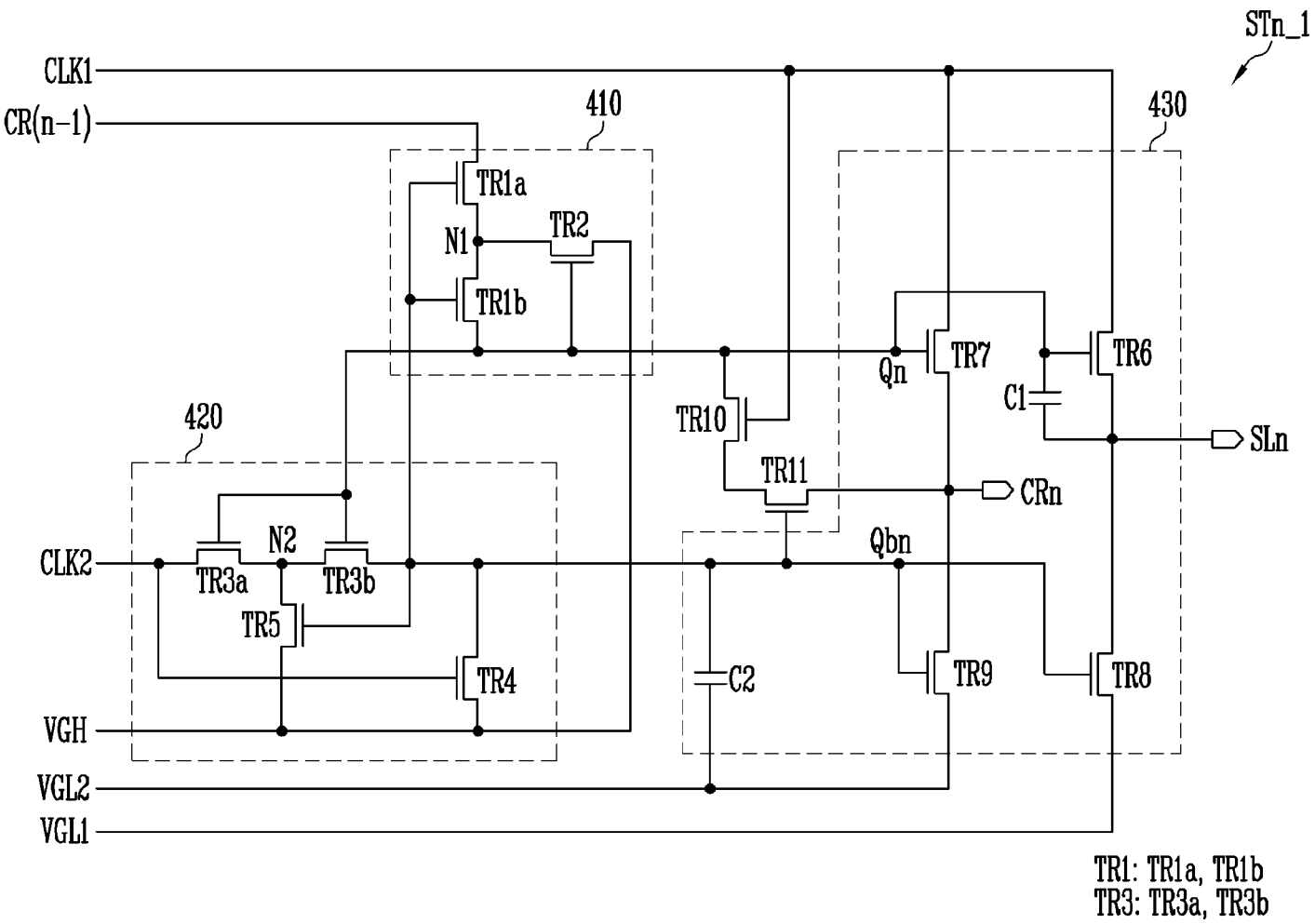
FIG. 6 is an equivalent circuit diagram illustrating an example of the n-th scan stage included in the scan driver of FIG. 3.

FIG. 6 is a circuit diagram illustrating an example of the n-th scan stage included in the scan driver of FIG. 3.

Referring to FIGS. 4 and 6, except for a tenth transistor TR10 and an eleventh transistor TR11, since the n-th scan stage STn_1 of FIG. 6 may be substantially similar to the n-th scan stage STn of FIG. 4, duplicate descriptions will not be repeated.

The n-th scan stage STn_1 may include the tenth transistor TR10 and the eleventh transistor TR11.

In the tenth transistor TR10, a gate electrode may be electrically connected to the first clock line CLK1, an electrode may be electrically connected to the first driving node Qn, and another electrode may be electrically connected to an electrode of the eleventh transistor TR11.

In the eleventh transistor TR11, a gate electrode may be electrically connected to the second driving node Qbn, an electrode may be electrically connected to an electrode of the tenth transistor TR10, and another electrode may be the n-th carry line CRn (or, the other electrode of the ninth transistor TR9).

Referring to FIGS. 5 and 6, at the fourth time point t4, a pulse of a high level may be applied to the first clock line CLK1. In this case, the tenth transistor TR10 may be turned on. For example, the ninth transistor TR9 and the eleventh transistor TR11 may be turned on or maintain a turn-on state in response to a voltage of a high level of the second driving node Qbn. Therefore, the first driving node Qn may be discharged to a third voltage of a low level provided through the third power line VGL2.

As described with reference to FIGS. 5 and 6, the n-th scan stage STn_1 including the tenth transistor TR10 and the eleventh transistor TR11 may additionally discharge the first driving node Qn through the tenth transistor TR10 and the eleventh transistor TR11 after outputting the n-th scan signal and the n-th carry signal.

Figure 7:
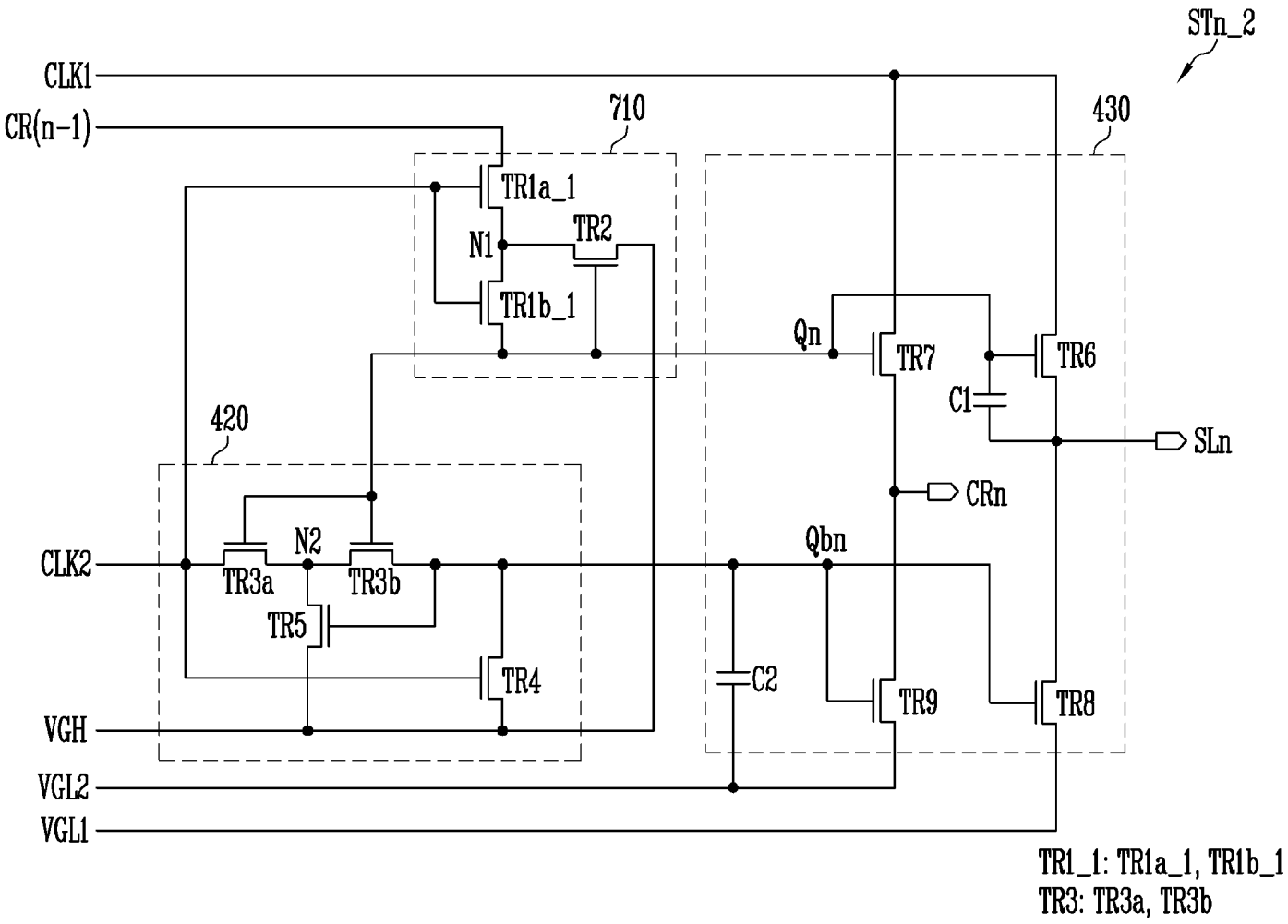
FIG. 7 is an equivalent circuit diagram illustrating an example of the n-th scan stage included in the scan driver of FIG. 3.

FIG. 7 is a circuit diagram illustrating an example of the n-th scan stage included in the scan driver of FIG. 3.

Referring to FIGS. 4 and 7, except for a first driving circuit 710 (or a connection configuration of a first transistor TR1_1), since the n-th scan stage STn_2 of FIG. 7 may be substantially similar to the n-th scan stage STn of FIG. 4, duplicate descriptions will not be repeated.

The n-th scan stage STn_2 may include the first driving circuit 710, the second driving circuit 420, and the output circuit 430.

The first driving circuit 710 may include the first transistor TR1_1 and the second transistor TR2. The first driving circuit 710 may control the voltage of the first driving node Qn, based on the input signal that may be any one of the scan start signal and the previous carry signal, and the second clock signal provided through the second clock line CLK2.

In the first transistor TR1_1, a gate electrode may be electrically connected to the second clock line CLK2, an electrode may be electrically connected to the (n−1)-th carry line CR(n−1), and another electrode may be electrically connected to the first driving node Qn.

In an embodiment, the first transistor TR1_1 may include a first sub transistor TR1*a*_1 and a second sub transistor TR1*b*_1 that may be electrically connected in series. In the first sub transistor TR1*a*_1, a gate electrode may be electrically connected to the second clock line CLK2, an electrode may be electrically connected to the (n−1)-th carry line CR(n−1), and another electrode may be electrically connected to the first node N1 (or an electrode of the second sub transistor TR1*b*_1). In the second sub transistor TR1*b*_1, a gate electrode may be electrically connected to the second clock line CLK2, an electrode may be electrically connected to the first node N1, and another electrode may be electrically connected to the first driving node Qn.

Referring to FIGS. 5 and 7, at the first time point t1, a pulse of a high level may be applied to the (n−1)-th carry line CR(n−1). For example, a pulse of a high level may be applied to the second clock line CLK2. In this case, since the first sub transistor TR1*a*_1 and the second sub transistor TR1*b*_1 may be turned on or maintain a turn-on state, the first driving node Qn may be charged to the high level applied to the (n−1)-th carry line CR(n−1).

At the second time point t2, a signal of a low level may be applied to the second clock line CLK2. In this case, the first sub transistor TR1*a*_1 and the second sub transistor TR1*b*_1 may be turned off.

At the third time point t3, a pulse of a high level may occur in the second clock line CLk2. In this case, the first sub transistor TR1*a*_1 and the second sub transistor TR1*b*_1 may be turned on. Therefore, the first driving node Qn may be discharged to the low level applied to the (n−1)-th clock line CR(n−1).

After the third time point t3, even though a pulse of a high level may be generated in the second clock line CLK2 and thus the first sub transistor TR1*a*_1 and the second sub transistor TR1*b*_1 may be turned on, since the pulse of the low level may be maintained at the (n−1)-th carry line CR(n−1), the first driving node Qn may maintain the voltage of the low level. Therefore, the sixth transistor TR6 and the seventh transistor TR7 may be turned off or maintain a turn-off state.

As described with reference to FIGS. 5 and 7, even though the gate electrode of the first sub transistor TR1*a*_1 and the gate electrode of the second sub transistor TR1*b*_1 may be electrically connected to the second clock line CLK2, the n-th scan stage STn_2 of FIG. 7 may operate substantially the same as or similar to the n-th scan stage STn of FIG. 4.

Figure 8:
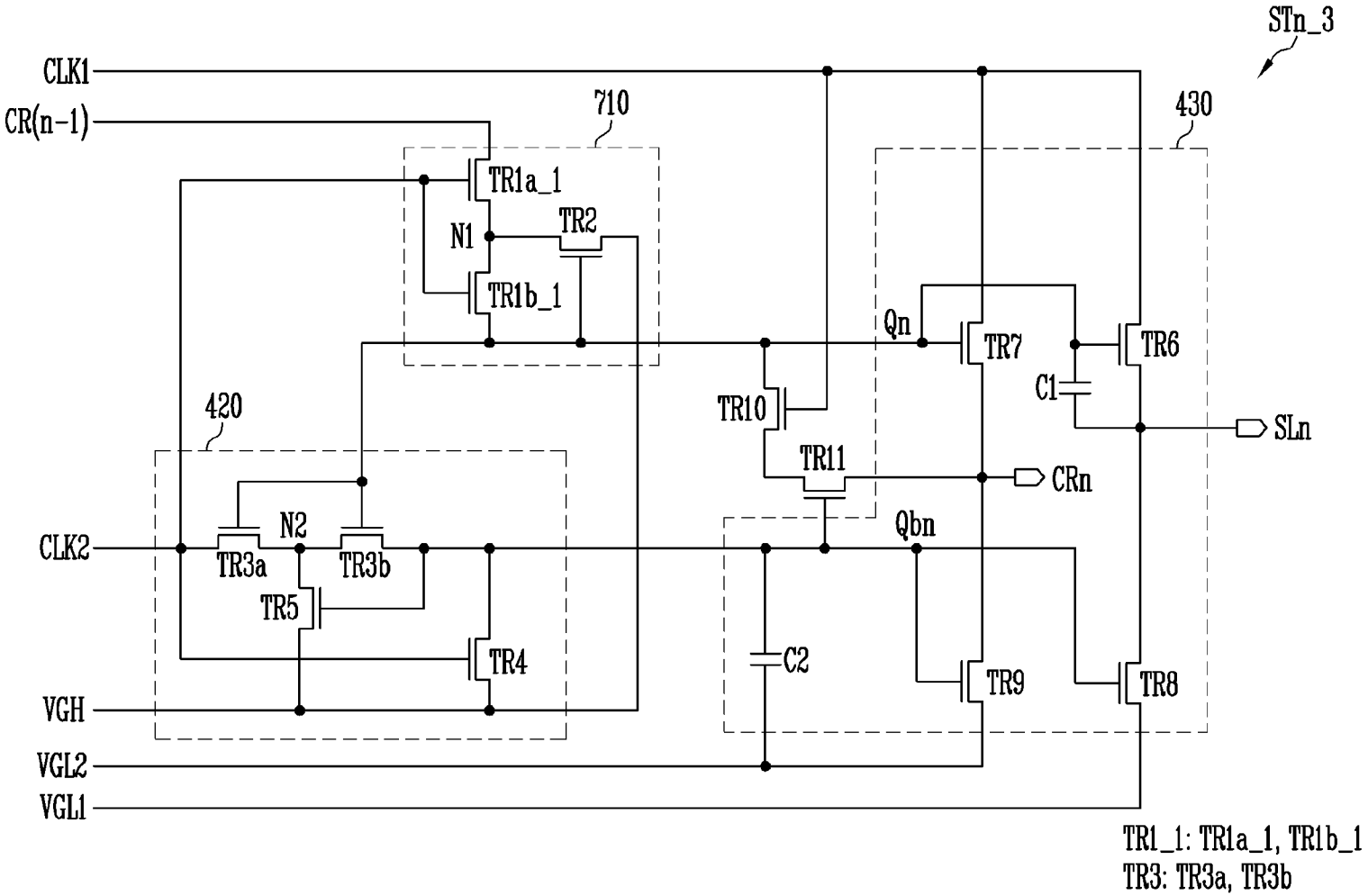
FIG. 8 is an equivalent circuit diagram illustrating an example of the n-th scan stage included in the scan driver of FIG. 3.

FIG. 8 is a circuit diagram illustrating an example of the n-th scan stage included in the scan driver of FIG. 3.

Referring to FIGS. 7 and 8, except for the tenth transistor TR10 and the eleventh transistor TR11, since the n-th scan stage STn_3 of FIG. 8 may be substantially similar to the n-th scan stage STn_2 of FIG. 7, duplicate descriptions will not be repeated.

The n-th scan stage STn_3 may include the tenth transistor TR10 and the eleventh transistor TR11.

Referring to FIGS. 6 and 8, since the tenth transistor TR10 and the eleventh transistor TR11 of FIG. 8 may be substantially the same as or similar to the tenth transistor TR10 and the eleventh transistor TR11 of FIG, duplicate descriptions will not be repeated.

The n-th scan stage STn_3 including the tenth transistor TR10 and the eleventh transistor TR11 may additionally discharge the first driving node Qn through the tenth transistor TR10 and the eleventh transistor TR11 after outputting the n-th scan signal and the n-th carry signal.

Figure 9:
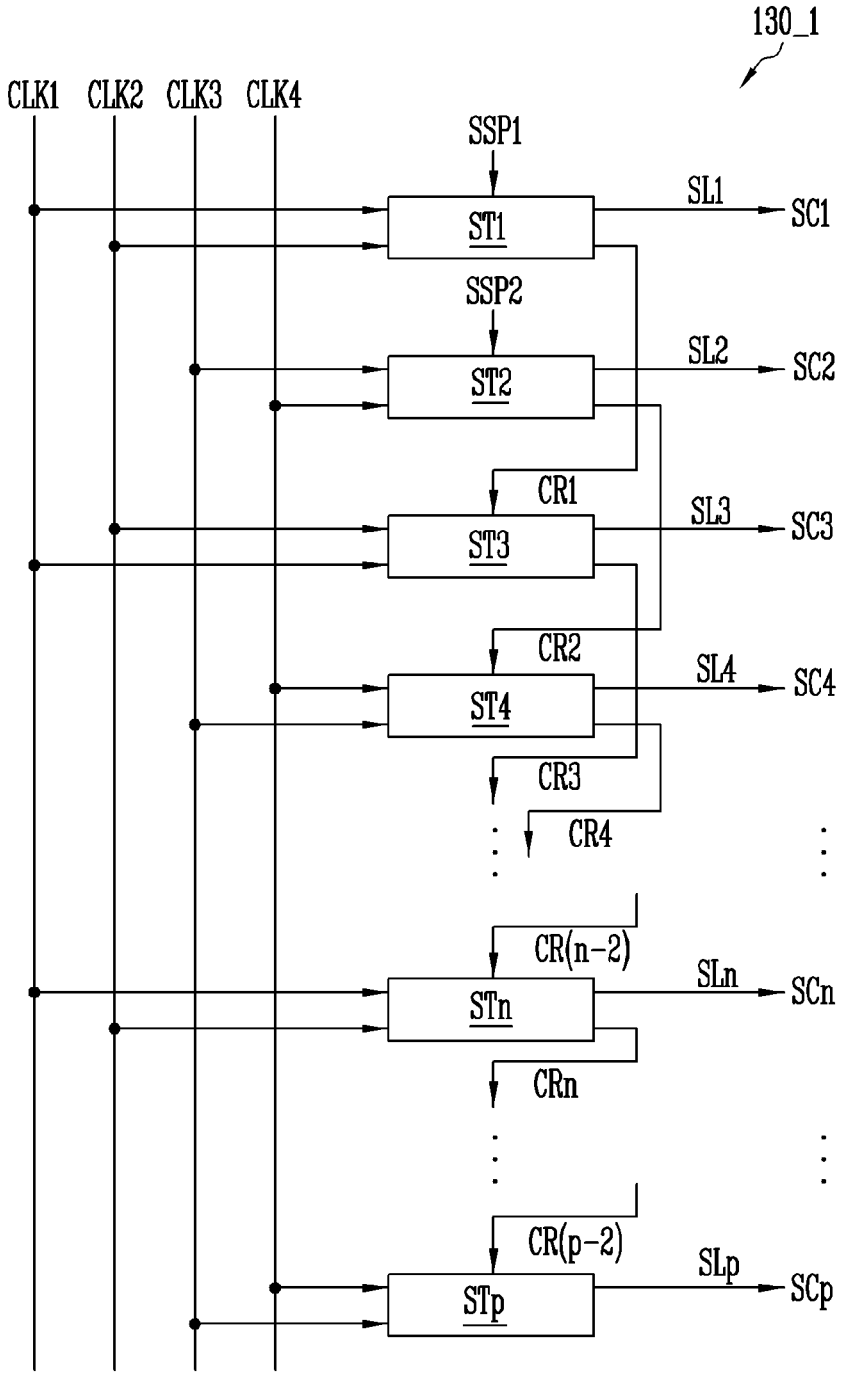
FIG. 9 is a diagram illustrating an example of the scan driver included in the display device of FIG. 1.

FIG. 9 is a diagram illustrating an example of the scan driver included in the display device of FIG. 1.

Referring to FIGS. 3 and 9, except for a connection configuration of first and second scan start lines SSP1 and SSP2 and carry lines CR1 to CR(p−2), since the scan driver 130_1 of FIG. 9 may be substantially the same as or similar to the scan driver 130 of FIG. 3, duplicate descriptions will not be repeated.

The scan stages ST1 to STp may be electrically connected to the input line providing the input signal that may be any one of the scan start signal and the previous carry signal. The scan start signal may include a first scan start signal and a second scan start signal. The input line may include the first scan start line SSP1 that may provide the first scan start signal, the second scan start line SSP2 that may provide the second scan start signal, and the carry lines CR1 to CR(p−2). Meanwhile, the first scan start signal may be substantially the same as or similar to the second scan start signal.

In an embodiment, the first scan stage ST1 may be electrically connected to the first scan start line SSP1, the second scan stage ST2 may be electrically connected to the second scan start line SSP2, and an s-th (s may be a natural number equal to or greater than three and equal to or less than p) may be electrically connected to an (s−2)-th carry line that may provide a carry signal output from an (s−2)-th scan stage. For example, the third scan stage ST3 may be electrically connected to the first carry line CR1, the fourth scan stage ST4 may be electrically connected to the second carry line CR2, the n-th scan stage STn may be electrically connected to the (n−2)-th carry line CR(n−2), and the p-th scan stage STp may be electrically connected to the (p−2)-th carry line CR(p−2).

When the display device performs an operation of displaying an image or images, the scan driver 130_1 may sequentially apply the scan signal to the first to p-th scan lines SL1 to SLp in response to the first scan start signal provided by the first scan start line SSP1 and the second scan start signal provided by the second scan start line SSP2. For example, the first scan stage ST1 may output the first scan signal SC1 through the first scan line SL1 in response to the first scan start signal, the second scan stage ST2 may output the second scan signal SC2 through the second scan line SL2 in response to the second scan start signal after the first scan stage ST1 outputs the first scan signal SC1, the third scan stage ST3 may output the third scan signal SC3 through the third scan line SL3 in response to the first carry signal after the second scan stage ST2 outputs the second scan signal SC2, the fourth scan stage ST4 may output the fourth scan signal SC4 through the fourth scan line SL4 in response to the second carry signal after the third scan stage ST3 outputs the third scan signal SC3, the n-th scan stage STn may output the n-th scan signal SCn through the n-th scan line SLn in response to the (n−2)-th carry signal after the (n−1)-th scan stage outputs the (n−1)-th scan signal, and the p-th scan stage STp may output the p-th scan signal SCp through the p-th scan line SLn in response to the (p−2)-th carry signal after the (p−1)-th scan stage outputs the (p−1)-th scan signal.

Referring to FIGS. 4 and 6 to 9, since the first scan stage ST1 of FIG. 9 may be electrically connected to the first scan start line SSP1, an electrode of the first transistor TR1 or TR1_1 and an electrode of the first sub transistor TR1*a* or TR1*a*_1 included in the first scan stage ST1 may be electrically connected to the first scan start line SSP1. For example, since the second scan stage ST2 of FIG. 9 may be electrically connected to the second scan start line SSP2, an electrode of the first transistor TR1 or TR1_1 and an electrode of the first sub transistor TR1*a* or TR1*a*_1 included in the second scan stage ST2 may be electrically connected to the second scan start line SSP2.

Since the n-th scan stage STn of FIG. 9 (except for the first scan stage ST1 and the second scan stage STn) may be electrically connected to the (n−2)-th carry line CR(n−2), an electrode of the first transistor TR1 or TR1_1 and an electrode of the first sub transistor TR1*a* or TR1*a*_1 included in the n-th scan stage STn may be electrically connected to the (n−2)-th carry line CR(n−2).

Figure 10:
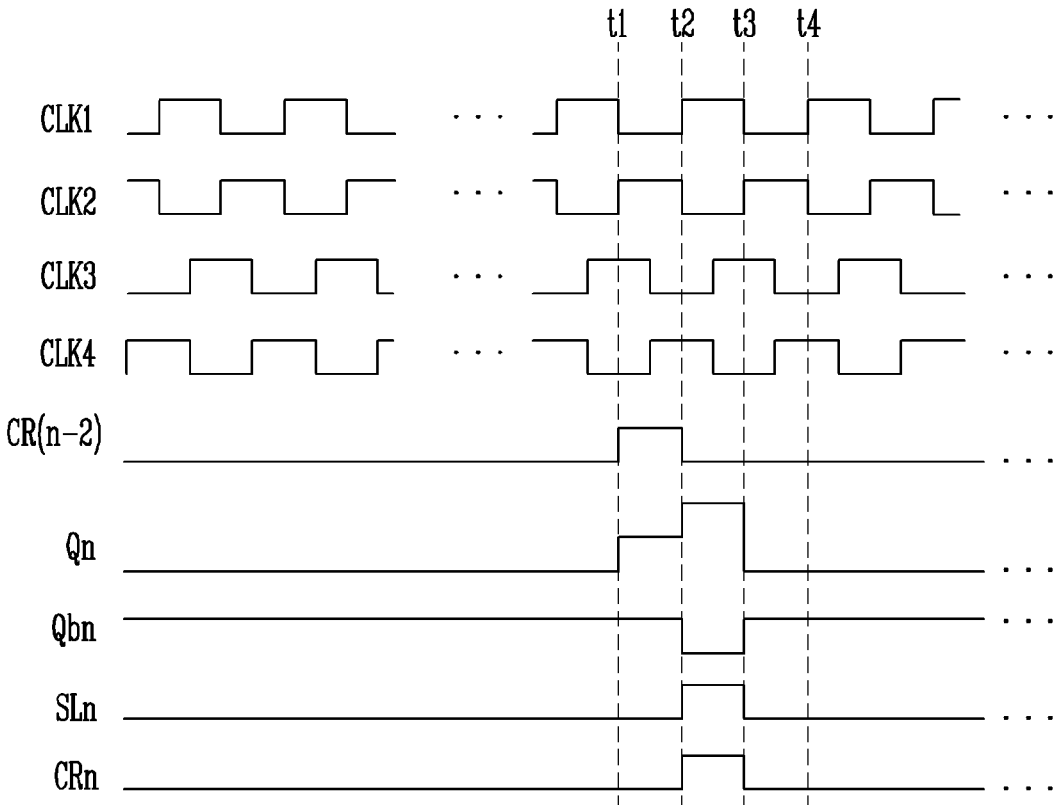
FIG. 10 is a waveform diagram illustrating a driving method of the scan driver of FIG. 9.

FIG. 10 is a waveform diagram illustrating a driving method of the scan driver of FIG. 9.

Referring to FIGS. 5 and 10, as the n-th scan stage STn of the scan driver 130_1 of FIG. 9 may be electrically connected to the (n−2)-th carry line CR(n−2), the waveform diagram of FIG. 10 may be substantially the same as or similar to the waveform diagram of FIG. 5 except that FIG. 10 shows the signal applied to the (n−2)-th carry line CR(n−2) instead of the signal applied to the line (n−1)-th carry line CR(n−1). Therefore, in the description with reference to FIG. 10, descriptions duplicate with those described with reference to FIGS. 3 to 8 will not be repeated.

Referring to FIGS. 4 and 6 to 10, as described above, since the n-th scan stage STn of FIG. 9 may be electrically connected to the (n−2)-th carry line CR(n−2), the description will be given by way of example that an electrode of the first transistor TR1 (or an electrode of first sub transistor TR1*a*) may be electrically connected to (n−2)-th carry line CR(n−2).

The first scan start signal applied to the first scan stage ST1 and the second scan start signal applied to the second scan stage ST2 may control the start timing of the scan signal output from the scan driver 130. For example, the timing at which the first scan stage ST1 may output the first scan signal and the timing at which the second scan stage ST2 may output the second scan signal may be controlled. Therefore, an operation of the first scan stage ST1 electrically connected to the first scan start line SSP1 and an operation of the second scan stage ST2 electrically connected to the second scan start line SSP2 may be substantially similar to an operation of the n-th scan stage STn electrically connected to the (n−2)-th carry line CR(n−2), which will be described below.

Referring to FIGS. 4, 9, and 10, at the first time point t1, a pulse of a high level may be applied to the (n−2)-th carry line CR(n−2). For example, a voltage of a high level may be maintained at the second driving node Qbn. In this case, since the first sub transistor TR1*a* and the second sub transistor TR1*b* may be turned on or maintain a turn-on state, the first driving node Qn may be charged to the high level applied to the (n−2)-th carry line CR(n−2).

At the third time point t3, a pulse of a high level may occur in the second clock line CLK2. In this case, the second driving node Qbn may be charged to the high level applied to the second clock line CLK2. Therefore, the first sub transistor TR1*a* and the second sub transistor TR1*b* may be turned on. In this case, the first driving node Qn may be discharged to the low level applied to the (n−2)-th carry line CR(n−2).

At the fourth time point t4, a pulse of a high level may occur in the first clock line CLK1. However, after the third time point t3, since a pulse of a low level may be maintained at the (n−2)-th carry line CR(n−2), the first driving node Qn may maintain the voltage of the low level according to the pulse of the low level applied to the (n−2)-th carry line CR(n−2). Therefore, the sixth transistor TR6 and the seventh transistor TR7 may be turned off or maintain a turn-off state.

Referring to FIGS. 4, 6, 9, and 10, the scan driver 130_1 of FIG. 9 may include the n-th scan stage STn_1 of FIG. 6. For example, except for the tenth transistor TR10 and the eleventh transistor TR11, since the n-th scan stage STn_1 of FIG. 6 may be substantially the same as or similar to the n-th scan stage STn of FIG. 4, the n-th scan stage STn_1 of FIG. 6 may operate substantially the same as the n-th scan stage STn of FIG. 4.

Referring to FIGS. 4, 7, 9, and 10, the scan driver 130_1 of FIG. 9 may include the n-th scan stage STn_2 of FIG. 7. For example, except for the first driving circuit 710 (or a connection configuration of the first transistor TR1_1), since the n-th scan stage STn_2 of FIG. 7 may be substantially the same as or similar to the n-th scan stage STn of FIG. 4, duplicate descriptions will not be repeated.

Referring to FIGS. 7, 9, and 10, at the first time point t1, a pulse of a high level may be applied to the (n−2)-th carry line CR(n−2). For example, a pulse of a high level may be applied to the second clock line CLK2. In this case, since the first sub transistor TR1*a*_1 and the second sub transistor TR1*b*_1 may be turned on or maintain a turn-on state, the first driving node Qn may be charged to the high level applied to the (n−2)-th carry line CR(n−2).

At the third time point t3, a pulse of a high level may occur in the second clock line CLK2. In this case, the first sub transistor TR1*a*_1 and the second sub transistor TR1*b*_1 may be turned on. Therefore, the first driving node Qn may be discharged to the low level applied to the (n−2)-th carry line CR(n−2).

After the third time point t3, even though a pulse of a high level may be generated in the second clock line CLK2 and thus the first sub transistor TR1*a*_1 and the second sub transistor TR1*b*_1 may be turned on, since the pulse of the low level may be maintained at the (n−2)-th carry line CR(n−2), the first driving node Qn may maintain the voltage of the low level. Therefore, the sixth transistor TR6 and the seventh transistor TR7 may be turned off or maintain a turn-off state.

Referring to FIGS. 7 to 10, the scan driver 130_1 of FIG. 9 may include the n-th scan stage STn_3 of FIG. 8. For example, except for the tenth transistor TR10 and the eleventh transistor TR11, since the n-th scan stage STn_3 of FIG. 8 may be substantially the same as or similar to the n-th scan stage STn_2 of FIG. 7, the n-th scan stage STn_3 of FIG. 8 may operate substantially the same as or similar to the n-th scan stage STn_2 of FIG. 7.

As described with reference to FIGS. 9 and 10, even though the first scan start line SSP1 may be electrically connected to the first scan stage ST1, the second scan start line SSP2 may be electrically connected to the second scan stage ST2, and the (n−2)-th carry line CR(n−2) may be electrically connected to the n-th scan stage STn (except for the first scan stage ST1 and the second scan stage ST2), the scan driver 130_1 of FIG. 9 may operate substantially the same as the scan driver 130 of FIG. 3.

The referred drawings and the detailed description of the disclosure described are merely examples of the disclosure, are used for merely describing the disclosure, and are not intended to limit the meaning and the scope of the disclosure described in the claims. Therefore, those skilled in the art may understand that various modifications and equivalent other embodiments are possible from the teachings of the disclosure.

What is claimed is:

1. A scan driver including a plurality of scan stages, an n-th scan stage of the plurality of the scan stages comprising:

a first driving circuit that controls a voltage of a first driving node based on an input signal and a voltage of a second driving node, wherein the input signal is a scan start signal or a previous carry signal;

a second driving circuit that controls the voltage of the second driving node based on a second clock signal and a first voltage; and an output circuit that outputs a first clock signal as a scan signal and a separate carry signal based on the voltage of the first driving node, and outputs a second voltage as the scan signal and the separate carry signal based on the voltage of the second driving node, wherein the first driving circuit includes a first transistor including a gate electrode electrically connected to the second driving node, one electrode electrically connected to an input line that provides the input signal, and another electrode electrically connected to the first driving node, and n is natural number equal to or greater than one.

2. The scan driver according to claim 1, wherein each of the plurality of the scan stages is electrically connected to two clock lines among a first clock line that provides the first clock signal, a second clock line that provides the second clock signal, a third clock line that provides a third clock signal, and a fourth clock line that provides a fourth clock signal.

3. The scan driver according to claim 2, wherein the first clock signal, the second clock signal, the third clock signal, and the fourth clock signal are set at a same period, the second clock signal is delayed by a phase difference of a ½ period from the first clock signal, the third clock signal is delayed by a phase difference of a ¼ period from the first clock signal, and the fourth clock signal is delayed by a phase difference of a ½ period from the third clock signal.

4. The scan driver according to claim 3, wherein an m-th scan stage among the plurality of the scan stages is electrically connected to the first clock line and the second clock line, and an (m+1)-th scan stage among the plurality of the scan stages is electrically connected to the third clock line and the fourth clock line, wherein m is a natural number equal to or greater than one.

5. The scan driver according to claim 1, wherein the first transistor comprises:

a first sub transistor including a gate electrode electrically connected to the second driving node, and one electrode electrically connected to the input line; and a second sub transistor including a gate electrode electrically connected to the second driving node, one electrode electrically connected to the other electrode of the first sub transistor, and another electrode electrically connected to the first driving node.

6. The scan driver according to claim 5, wherein the first driving circuit includes a second transistor including:

a gate electrode electrically connected to the first driving node;

one electrode electrically connected to a first power line that provides the first voltage; and another electrode electrically connected to the other electrode of the first sub transistor.

7. The scan driver according to claim 1, wherein the input line electrically connected to the one electrode of the first transistor included in a first scan stage is a scan start line that provides the scan start signal, and the input line electrically connected to the one electrode of the first transistor included in an r-th scan stage is an (r−1)-th carry line that provides a carry signal output from an (r−1)-th scan stage, wherein r is a natural number equal to or greater than two.

8. The scan driver according to claim 1, wherein the scan start signal includes a first scan start signal and a second scan start signal, the input line electrically connected to the one electrode of the first transistor included in a first scan stage is a first scan start line that provides the first scan start signal, the input line electrically connected to the one electrode of the first transistor included in a second scan stage is a second scan start line that provides the second scan start signal, and the input line electrically connected to the one electrode of the first transistor included in an s-th scan stage is an (s−2)-th carry line that provides a carry signal output from an (s−2)-th scan stage, wherein s is a natural number equal to or greater than three.

9. A scan driver including a plurality of scan stages, an n-th scan stage of the plurality of the scan stages comprising:

a first driving circuit that controls a voltage of a first driving node based on an input signal and a voltage of a second driving node, wherein the input signal is a scan start signal or a previous carry signal;

a second driving circuit that controls the voltage of the second driving node based on a second clock signal and a first voltage; and an output circuit that outputs a first clock signal as a scan signal and a separate carry signal based on the voltage of the first driving node, and outputs a second voltage as the scan signal and the separate carry signal based on the voltage of the second driving node, wherein the first driving circuit includes a first transistor including a gate electrode electrically connected to the second driving node, one electrode electrically connected to an input line that provides the input signal, and another electrode electrically connected to the first driving node, n is natural number equal to or greater than one, and the second driving circuit included in the n-th scan stage comprises:

a third transistor including a gate electrode electrically connected to the first driving node, one electrode electrically connected to a second clock line that provides the second clock signal, and another electrode electrically connected to the second driving node; and a fourth transistor including a gate electrode electrically connected to the second clock line, one electrode electrically connected to a first power line, and another electrode electrically connected to the second driving node.

10. The scan driver according to claim 9, wherein the third transistor comprises:

a third sub transistor including a gate electrode electrically connected to the first driving node, and one electrode electrically connected to the second clock line; and a fourth sub transistor including a gate electrode electrically connected to the first driving node, one electrode electrically connected to another electrode of the third sub transistor, and another electrode electrically connected to the second driving node.

11. The scan driver according to claim 10, wherein the second driving circuit includes a fifth transistor including:

a gate electrode electrically connected to the second driving node;

one electrode electrically connected to the first power line; and another electrode electrically connected to the other electrode of the third sub transistor.

12. The scan driver according to claim 11, wherein the n-th scan stage comprises:

a tenth transistor including a gate electrode electrically connected to a first clock line that provides the first clock signal, and one electrode electrically connected to the first driving node; and an eleventh transistor including a gate electrode electrically connected to the second driving node, one electrode electrically connected to another electrode of the tenth transistor, and another electrode electrically connected to an n-th carry line that outputs the separate carry signal.

13. The scan driver according to claim 10, wherein the output circuit included in the n-th scan stage comprises:

a sixth transistor including a gate electrode electrically connected to the first driving node, one electrode electrically connected to a first clock line that provides the first clock signal, and another electrode electrically connected to an n-th scan line that outputs the scan signal;

a seventh transistor including a gate electrode electrically connected to the first driving node, one electrode electrically connected to the first clock line, and another electrode electrically connected to an n-th carry line that outputs the separate carry signal; and a first capacitor including one electrode electrically connected to the gate electrode of the sixth transistor and another electrode electrically connected to the n-th scan line.

14. The scan driver according to claim 13, wherein the output circuit included in the n-th scan stage comprises:

an eighth transistor including a gate electrode electrically connected to the second driving node, one electrode electrically connected to a second power line that provides the second voltage, and another electrode electrically connected to the n-th scan line;

a ninth transistor including a gate electrode electrically connected to the second driving node, one electrode electrically connected to a third power line that provides a third voltage, and another electrode electrically connected to the n-th carry line; and a second capacitor including one electrode electrically connected to the second driving node and another electrode electrically connected to the second power line.

15. The scan driver according to claim 14, wherein the output circuit included in the n-th scan stage includes the second capacitor including the one electrode electrically connected to the second driving node and another electrode electrically connected to the third power line.

16. A scan driver including a plurality of scan stages, an n-th scan stage of the plurality of the scan stages comprising:

a first driving circuit that controls a voltage of a first driving node based on an input signal and a second clock signal, wherein the input signal is a scan start signal or a previous carry signal;

a second driving circuit that controls a voltage of a second driving node based on the second clock signal and a first voltage; and an output circuit that outputs a first clock signal as a scan signal and a separate carry signal based on the voltage of the first driving node, and outputs a second voltage as the scan signal and the separate carry signal based on the voltage of the second driving node, wherein the first driving circuit includes a first transistor including a gate electrode electrically connected to a second clock line that provides the second clock signal, one electrode electrically connected to an input line that provides the input signal, and another electrode electrically connected to the first driving node, and n is a natural number equal to or greater than one.

17. The scan driver according to claim 16, wherein each of the plurality of the scan stages is electrically connected to two clock lines among a first clock line that provides the first clock signal, the second clock line, a third clock line that provides a third clock signal, and a fourth clock line that provides a fourth clock signal.

18. The scan driver according to claim 17, wherein the first clock signal, the second clock signal, the third clock signal, and the fourth clock signal are set at a same period, the second clock signal is delayed by a phase difference of a ½ period from the first clock signal, the third clock signal is delayed by a phase difference of a ¼ period from the first clock signal, and the fourth clock signal is delayed by a phase difference of a ½ period from the third clock signal.

19. The scan driver according to claim 18, wherein an m-th scan stage among the plurality of the scan stages is electrically connected to the first clock line and the second clock line, and an (m+1)-th scan stage among the plurality of the scan stages is electrically connected to the third clock line and the fourth clock line, wherein m is a natural number equal to or greater than one.

20. The scan driver according to claim 16, wherein the first transistor comprises:

a first sub transistor including a gate electrode electrically connected to the second clock line, and one electrode electrically connected to the input line; and a second sub transistor including a gate electrode electrically connected to the second clock line, one electrode electrically connected to the other electrode of the first sub transistor, and another electrode electrically connected to the first driving node, and wherein the first driving circuit includes a second transistor including:

a gate electrode electrically connected to the first driving node;

one electrode electrically connected to a first power line that provides the first voltage; and another electrode electrically connected to the other electrode of the first sub transistor.

* * * * *